US008800462B2

(12) United States Patent
Fenini et al.

(10) Patent No.: US 8,800,462 B2
(45) Date of Patent: Aug. 12, 2014

(54) TRACTION METHOD AND SYSTEM FOR AN OPERATING LINE, IN PARTICULAR A MOORING LINE, OF A FLOATING PRODUCTION UNIT

(75) Inventors: Alessandro Fenini, Vizzolo Predabissi (IT); Gianfranco Gamba, Bergamo (IT)

(73) Assignee: Saipem S.p.A., San Donato Milanese (IT)

( * ) Notice: Subject to any disclaimer, the term of this patent is extended or adjusted under 35 U.S.C. 154(b) by 85 days.

(21) Appl. No.: 13/146,292

(22) PCT Filed: Jan. 25, 2010

(86) PCT No.: PCT/IB2010/000127

§ 371 (c)(1),
(2), (4) Date: Nov. 15, 2011

(87) PCT Pub. No.: WO2010/084420

PCT Pub. Date: Jul. 29, 2010

(65) Prior Publication Data

US 2012/0111255 A1 May 10, 2012

(30) Foreign Application Priority Data

Jan. 26, 2009 (IT) ..... MI2009A0082

(51) Int. Cl.
*B63B 21/00* (2006.01)

(52) U.S. Cl.
USPC ..... 114/230.22; 114/230.2; 114/200; 114/293

(58) Field of Classification Search
USPC ..... 114/230.2–230.3
See application file for complete search history.

(56) References Cited

U.S. PATENT DOCUMENTS 3,300,187 A * 1/1967 Krogstad et al. ..... 254/284
3,805,728 A * 4/1974 Abraham ..... 114/200
3,912,228 A * 10/1975 Petty et al. ..... 114/230.23

(Continued)

FOREIGN PATENT DOCUMENTS

WO WO 2004/050470 6/2004
WO WO 2008/046874 4/2008

OTHER PUBLICATIONS

International Search Report and Written Opinion for International Application No. PCT/IB2010/000127, European Patent Office, The Netherlands, mailed on Jun. 4, 2010, 12 pages.

*Primary Examiner* — Lars A Olson
*Assistant Examiner* — Jovon Hayes
(74) *Attorney, Agent, or Firm* — Sterne, Kessler, Goldstein & Fox P.L.L.C.

(57) ABSTRACT

A traction method for an operating line, in particular a mooring line, of a floating production unit includes the steps of: attaching an end chain portion of the operating line to a socket of a main cable running through a sheave at a work station; reeling in the main cable, using a winch, to bring the socket of the main cable up to the sheave; locking the operating line with a chain stopper; slackening the main cable and moving the sheave closer to the chain stopper to reduce pull on the main cable; reeling in the main cable to run the socket of the main cable through the sheave; once the socket of the main cable has run through the sheave, releasing the operating line from the chain stopper, and reeling in, by means of the winch, the main cable and the operating line connected to it, to set the operating line to a given tension.

19 Claims, 3 Drawing Sheets

(56) References Cited

U.S. PATENT DOCUMENTS

| | | | | | |
|---|---|---|---|---|---|
| 3,917,229 | A * | 11/1975 | Ayme | 254/279 |
| 4,111,398 | A * | 9/1978 | Alexander et al. | 254/295 |
| 5,316,509 | A * | 5/1994 | Boatman et al. | 441/3 |
| 5,364,075 | A * | 11/1994 | Montgomery | 254/415 |
| 5,395,454 | A * | 3/1995 | Robert | 134/6 |
| 5,845,893 | A * | 12/1998 | Groves | 254/389 |
| 5,934,216 | A * | 8/1999 | Childers et al. | 114/230.1 |
| 6,044,787 | A * | 4/2000 | Elmbo | 114/242 |
| 6,435,121 | B2 * | 8/2002 | Siring | 114/200 |
| 6,651,580 | B2 * | 11/2003 | Lay et al. | 114/293 |
| 6,983,714 | B2 * | 1/2006 | Dove et al. | 114/293 |
| 7,059,262 | B2 * | 6/2006 | Dove et al. | 114/210 |
| 7,104,214 | B2 * | 9/2006 | Niebur | 114/230.2 |
| 7,240,633 | B2 * | 7/2007 | Barlow | 114/200 |
| 7,377,225 | B2 * | 5/2008 | Finn et al. | 114/264 |
| 7,392,757 | B2 * | 7/2008 | Niebur | 114/200 |
| 8,291,848 | B2 * | 10/2012 | Fenini et al. | 114/230.25 |
| 2005/0072347 | A1 * | 4/2005 | Niebur | 114/293 |
| 2005/0241558 | A1 | 11/2005 | Barlow | |
| 2012/0160146 | A1 * | 6/2012 | Miller et al. | 114/200 |

* cited by examiner

TRACTION METHOD AND SYSTEM FOR AN OPERATING LINE, IN PARTICULAR A MOORING LINE, OF A FLOATING PRODUCTION UNIT

TECHNICAL FIELD

The present invention relates to traction method and system for an operating line, in particular a mooring line, of a floating production unit, and to a floating production unit featuring such a system.

The method according to the invention is particularly suitable for "spread mooring" floating production units, to which application the following description refers purely by way of example.

BACKGROUND ART

As is known, floating production units (FPUs) and, specifically, floating production, storage and offloading (FPSO) vessels, widely used for off-shore hydrocarbon production, are normally converted ships anchored permanently by mooring lines to the sea bed.

A mooring line normally comprises a first chain portion, which is fixed to a mooring station on the unit by a locking device; a cable portion (e.g. of synthetic material); and a second chain portion terminating with an anchor.

Normally, there are several mooring lines attached to respective stations variously arranged on the unit according to the required mooring configuration (e.g. spread mooring).

The normal procedure is as follows.

So-called "turn-down sheaves" with respective mooring line stop devices, known as "chain stoppers", are set up on the unit, more specifically, along the sides of the ship; a chain portion, known as a "pilot" chain, is installed on each sheave; once the unit is in the mooring position, the mooring line, brought up to the unit by tenders, is connected to the pilot chain by a service chain portion, which attaches to the end link of the mooring line; the pilot chain is then connected to a winch to take up the pilot and service chains and tension the mooring line; and, once tensioned, the mooring line is locked by the respective stopper.

In one particularly advantageous solution described in International Patent Application n. WO2008/046874-A1, one main winch is used to tension all the mooring lines (as well as to handle other operating lines, such as production or extraction lines) by connecting the winch cable successively to the various chain portions for handling and/or tensioning.

The mooring method in the above International Patent Application, as well as others similar to it, are not without drawbacks.

A first of these lies in using winches. Normally, the end of the cable that attaches to the chain portions is defined by a cast head, known as a socket, which, as it runs through the sheave, tends to irreparably damage the cable.

A second drawback involves the orientation of the first link (of any chain portion) as it comes into contact with the sheave. Since it is practically impossible to ensure the first link of the incoming chain is in the ideal position to engage the sheave, and given also the amount of pull exerted by the cable when the chain reaches deck level, due to twisting of the cable, extremely hazardous situations may arise.

Systems more or less similar to the one described also pose the same problems.

DISCLOSURE OF INVENTION

It is an object of the present invention to provide a traction method and system for an operating line, in particular a mooring line, of a floating production unit, designed to eliminate the drawbacks of the known art.

According to the present invention, there are provided a traction method and system for an operating line, in particular a mooring line, of a floating production unit, as defined in general terms in accompanying claims 1 and 10 respectively, and in additional terms in the dependent Claims.

The method according to the invention, and the system implementing it, provide for safe, easy, reliable tensioning of operating lines, in particular mooring lines, of a floating production unit.

Despite the main cable for tensioning the operating (e.g. mooring) line being operated by a relatively simple, compact, low-cost winch, the invention prevents the main cable socket from damaging the cable when tensioning the line, and in particular as the socket engages the sheave at the work station, and also prevents hazardous situations arising as a result of the first chain link coming into contact with the sheave in an improper position and under severe pull.

According to the invention, in fact, the main cable socket engages the sheave with very little pull exerted on the cable, so the socket, even if tilted slightly with respect to the sheave, does not damage the cable. The small amount of pull on the cable also allows the first chain link to come into contact with the sheave in the correct position.

Also, connecting the main cable directly to the operating line eliminates the need for auxiliary chain portions and, therefore, all the work and equipment connected with handling them.

BRIEF DESCRIPTION OF THE DRAWINGS

A non-limiting embodiment of the present invention will be described by way of example with reference to the accompanying drawings, in which.

BEST MODE FOR CARRYING OUT THE INVENTION

Figure 1:
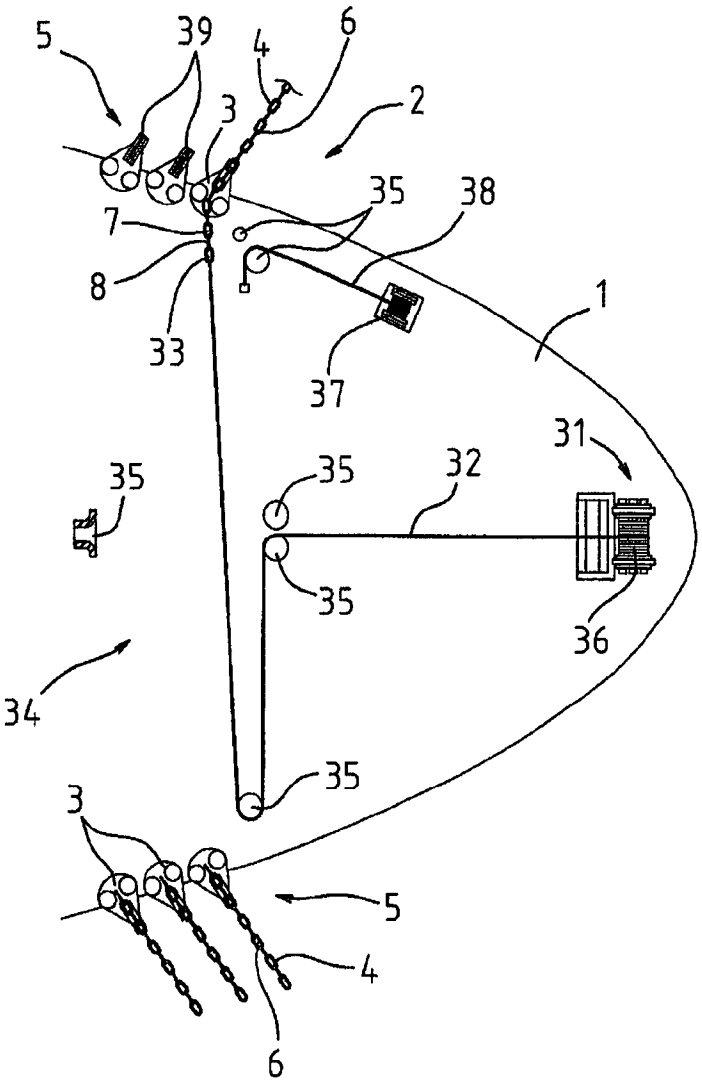
FIG. 1 shows a schematic, partial top plan view of a floating production unit equipped with an operating line, in particular a mooring line, traction system in accordance with the present invention.

Number 1 in FIG. 1 indicates a floating production unit, e.g. of the type commonly known as an FPSO and defined by a converted ship, only shown partly and schematically for the sake of simplicity.

Unit 1 comprises an operating line traction system 2, in turn comprising at least one work station 3, in particular a mooring station, which cooperates with an operating line 4, in particular a mooring line.

In the non-limiting FIG. 1 embodiment, unit 1 has a number of work stations 3 spaced along unit 1 and engaged by respective operating lines 4. More specifically, stations 3 comprise a number of mooring stations arranged along unit 1, optionally in groups 5 to form a spread mooring configuration, and engaged by respective mooring lines; and possibly also a number of production stations engaged by respective known hydrocarbon extraction lines, not shown for the sake of simplicity.

It is understood that stations 3 may be arranged differently on unit 1, and also in mooring configurations other than the one referred to by way of example, and may be used for purposes other than mooring unit 1, such as receiving production and other types of operating lines.

Whichever the case, each operating line 4 comprises at least one end chain portion 6, which engages a station 3 and has a free end 7 defined by a first chain link 8 (the first link in end chain portion 6). The rest of operating line 4 is formed in substantially known manner not shown. For example, if operating line 4 is a mooring line, end chain portion 6 is followed by a cable portion made of synthetic material, and a second chain portion terminating with an anchor. If operating line 4 is a production line, it comprises an extraction pipe connected to end chain portion 6.

Figure 3:
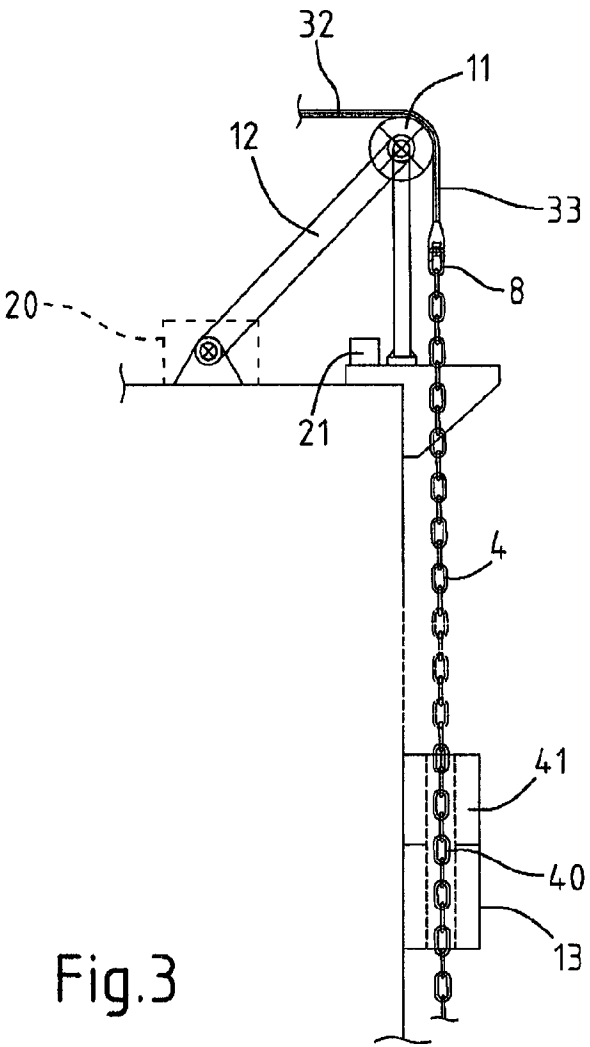
FIGS. 2 to 4 show a larger-scale detail of the FIG. 1 unit in different operating positions.
Figure 2:
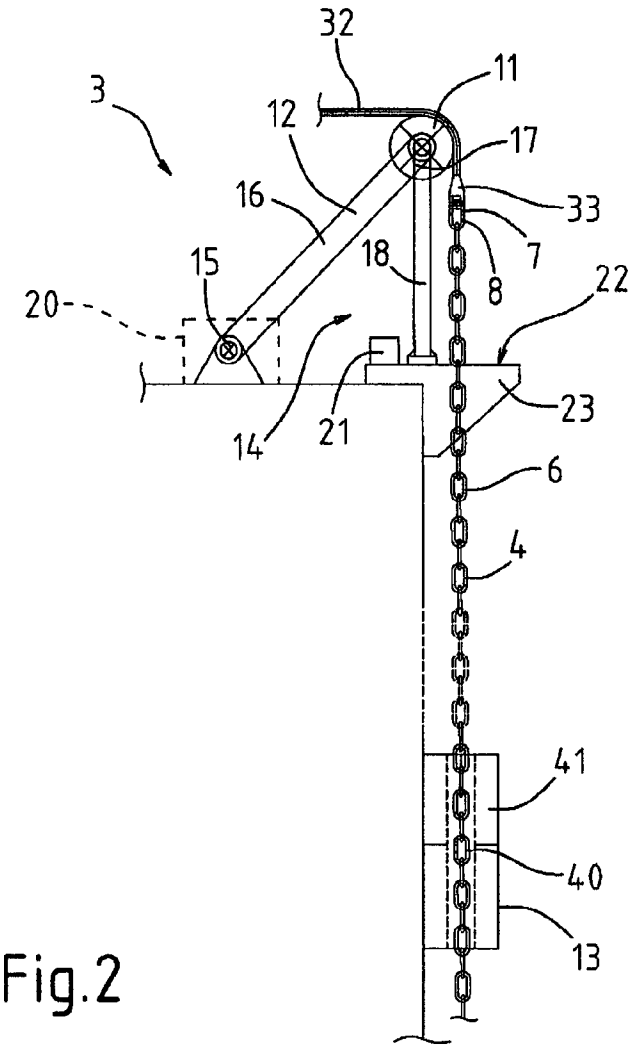
Figure 4:
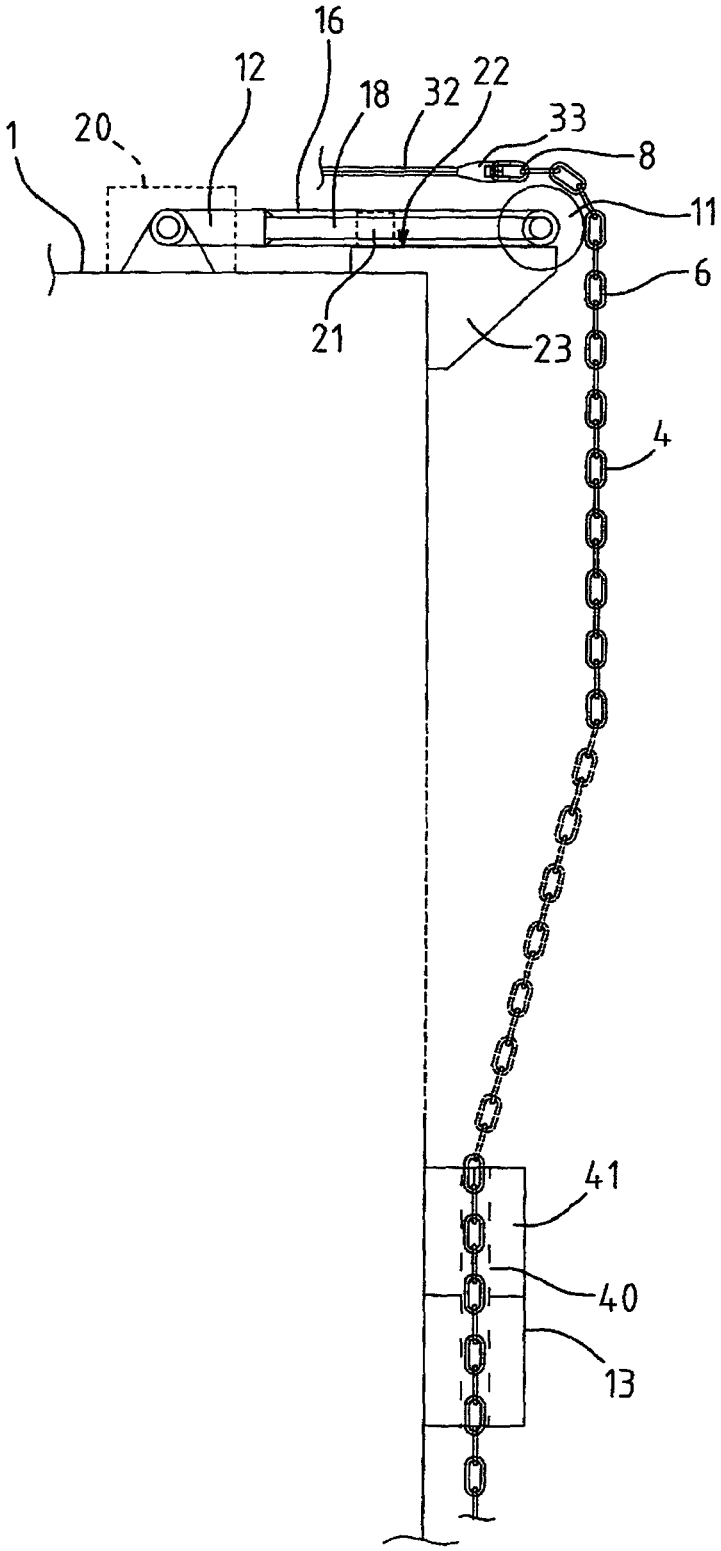

With reference also to FIGS. 2-4, each station 3 is engaged by an end chain portion 6 of an operating line 4, and comprises a top sheave 11 fitted to a movable support 12; and a chain stopper 13 for arresting operating line 4.

Sheave 11 and support 12 are installed on one side and/or along the edge of unit 1, and are located above water (above the waterline of unit 1), e.g. at main deck level. Stopper 13 may be located close to sheave 11, i.e. also above water, or lower, even below the surface of the water, is designed to lock onto a chain link of operating line 4 to support operating line 4, and may, for example, be of the type described in Patent Application US2005/241558.

Support 12 is movable selectively into at least two operating positions, in which sheave 11, fitted to support 12, is at respective different distances from stopper 13.

In the non-limiting example in FIGS. 2-4, support 12 comprises a compass structure 14, but may obviously be formed in any other equivalent manner.

In the example shown, support 12 comprises a hinge 15 fixed to unit 1; and an arm 16 (possibly comprising two fork-like members) projecting obliquely from hinge 15 and connected by hinge 15 to unit 1. Sheave 11 is located at a free end 17 of arm 16, preferably to project from the edge of unit 1; and sheave 11 and support 12 (specifically, arm 16) rotate about respective parallel axes of rotation.

Support 12 also comprises at least one collapsible supporting bar 18, e.g. hinged to end 17 of arm 16 to form compass structure 14.

Support 12 is operated by a known actuating device (only shown schematically by a dash line in FIG. 2).

Support 12 has a lock device 21, also known and only shown schematically, for locking support 12 in predetermined positions and preventing it from moving.

The operating positions assumed by support 12 are shown in FIGS. 2 and 4 respectively. In a first operating position shown in FIG. 2, compass structure 14 is parted, arm 16 projects obliquely from hinge 15, and bar 18 rests on a supporting surface 22 of a pedestal 23, fixed to unit 1, to support sheave 11 at a first predetermined distance from stopper 13. In a second operating position shown in FIG. 4, compass structure 14 is closed, and bar 18 is collapsed, substantially along or close to arm 16; arm 16 and/or bar 18 lie, for example, on supporting surface 22 and/or on pedestal 23; and sheave 11 is located at a second predetermined distance, less than the first distance, from stopper 13.

As shown in FIG. 1, system 2 also comprises a winch 31 having a main cable 32, in particular a metal (e.g. steel) cable, connected to winch 31 and terminating with a socket 33 for engaging chain portions.

In one particularly advantageous solution described in International Patent Application n. WO2008/046874-A1, which is included herein by way of reference, system 2 also comprises a cable transmission 34 comprising guide members 35 defining a number of paths by which to selectively direct main cable 32 to each work station 3 to engage a respective operating line 4. Stations 3 are thus all catered to by main cable 32 from winch 31 (which may therefore be used for both handling and tensioning mooring lines, and handling and hoisting production lines).

Winch 31 is preferably, though not necessarily, a horizontal-axis winch, and has a smooth or grooved drum 36 about which main cable 32 is coiled.

As described in detail in Patent Application WO2008/046874-A1, to which reference is made for further details, system 2 optionally comprises one or more auxiliary winches 37 located close to respective groups 5 of stations 3, and having respective auxiliary cables (e.g. of synthetic material) connectable to main cable 32 (directly or by further cable portions) to reel main cable 32 off winch 31 and feed it, along paths defined by guide members 35, into a number of positions close to respective stations 3.

Like most floating production units of the type described, each station 3 is associated with a substantially known fairlead 41—not described or shown in detail for the sake of simplicity—located (possibly, though not necessarily, immersed) below sheave 11 of station 3. In FIGS. 2-4, fairlead 41 (only shown schematically) is located next to stopper 13, e.g. to form with it a guide and stop assembly of the type described in US2005/0241558.

To implement the method of hauling and tensioning operating lines 4, specifically mooring lines, of unit 1 (in particular for spread mooring unit 1), system 2 operates as follows.

Once unit 1 is in the mooring position, end chain portion 6 of a first operating line 4 is brought, e.g. by tenders, up to station 3 of unit 1.

Socket 33 of main cable 32 is then attached to end chain portion 6. This is preferably done using a pilot cable 39 (only shown at some stations 3 in FIG. 1) set up beforehand on sheave 11 at station 3, and having one end connectable to socket 33 of main cable 32 to bring socket 33 up to operating line 4.

In which case, the method comprises the steps of:

- fitting sheave 11 with a pilot cable 39;
- attaching socket 33 of main cable 32 to pilot cable 39;
- slackening off pilot cable 39 to bring socket 33 of main cable 32 up to end 7 of end chain portion 6 of operating line 4;
- detaching pilot cable 39 from main cable 32, and attaching socket 33 of main cable 32 to the first link 8 of operating line 4.

At this point (or at least after otherwise bringing socket 33 of main cable 32 up to end chain portion 6 of operating line 4, and attaching socket 33 to the first link 8 of operating line 4), the method comprises the steps of:

- reeling in main cable 32, using winch 31, to bring socket 33 of main cable 32 up to sheave 11 (FIG. 2); support 12 at this point is in the first operating position;
- optionally feeding socket 33 of main cable 32 through fairlead 41;
- as socket 33 of main cable 32 contacts sheave 11, slackening main cable 32 (by reeling it off winch 31) so stopper 13 engages an intermediate link 40 of operating line 4 (FIG. 3);
- locking operating line 4 with stopper 13, so that operating line 4 is supported by stopper 13;
- slackening main cable 32 further, and at the same time moving support 12 of sheave 11 from the first to the second operating position, to bring sheave 11 closer to stopper 13 and so reduce (FIG. 4) the pull on main cable 32, i.e. exerted on main cable 32 by operating line 4 (by reducing the distance between sheave 11 and stopper 13, and supporting operating line 4 by stopper 13);

running socket 33 of main cable 32 through sheave (with practically no pull exerted, because operating line 4 is supported by stopper 13);

once socket 33 of main cable 32 has run through sheave 11, locking support 12 mechanically, e.g. using lock device 21, and releasing stopper 13 to free operating line 4;

reeling in main cable 32, using winch 31, to set operating line 4 to a given tension;

once the required tension is reached, locking operating line 4 again using stopper 13, and detaching main cable 32 from operating line 4.

As described in Patent Application WO2008/046874-A1, main cable 32 is advantageously fed up to each station 3 by cable transmission 34.

The above procedure is then repeated for each station 3 engaged by a respective operating line 4.

Clearly, changes may be made to the method and system as described and illustrated herein without, however, departing from the scope of the invention as defined in the accompanying Claims.

The invention claimed is:

1. A traction method for an operating line of a floating production unit, the operating line having at least one end chain portion which attaches to a work station on the unit, the method comprising the steps of:

setting up on the unit at least one work station, which is engaged by the operating line and comprises a top sheave fitted to a movable support, and a chain stopper for locking the operating line;

attaching the end chain portion of the operating line to a socket of a main cable;

reeling in the main cable, using a winch, to bring the socket of the main cable up to the sheave;

locking the operating line with the chain stopper;

slackening the main cable to reduce pull on the main cable, and moving the support of the sheave to bring the sheave closer to the chain stopper;

reeling in the main cable to run the socket of the main cable through the sheave; and once the socket of the main cable has run through the sheave, releasing the operating line from the chain stopper, and reeling in, using the winch, the main cable and the operating line connected to the main cable, to set the operating line to a given tension.

2. A method as claimed in claim 1, wherein the socket of the main cable is brought up to the end chain portion of the operating line, for attachment to said end chain portion, by a pilot cable.

3. A method as claimed in claim 1, wherein the step of attaching the end chain portion of the operating line to the socket of the main cable is preceded by the steps of:

fitting the sheave with a pilot cable;

attaching the socket of the main cable to the pilot cable; and slackening the pilot cable to bring the socket of the main cable up to the operating line.

4. A method as claimed in claim 1, wherein, once set to the given tension, the operating line is locked by the chain stopper and detached from the main cable.

5. A method as claimed in claim 1, wherein the step of slackening the main cable to reduce pull on the main cable comprises slackening the main cable to allow the chain stopper to engage a chain link of the operating line.

6. A method as claimed in claim 1, wherein the main cable is slackened to reduce pull on the main cable, while simultaneously moving the support of the sheave to bring the sheave closer to the chain stopper.

7. A method as claimed in claim 1, wherein, once the socket of the main cable is through the sheave, the support of the sheave is locked mechanically before the operating line is released from the chain stopper.

8. A method as claimed in claim 1, wherein, after engaging the operating line, the socket of the main cable is run through a fairlead.

9. A method as claimed in claim 1, wherein the main cable is run selectively to a number of work stations along respective paths defined by guide members.

10. A traction system for an operating line of a floating production unit, the system comprising:

at least one work station, which is engaged by an end chain portion of the operating line and comprises a top sheave, and a chain stopper for locking the operating line; and a winch having a main cable terminating with a socket for attachment to chain portions;

the system being characterized in that the sheave is fitted to a support movable selectively into at least two operating positions, in which the sheave is located at respective different distances from the chain stopper, to reduce pull on the main cable running through the sheave and connected to the operating line.

11. A system as claimed in claim 10, wherein the sheave is fitted with a pilot cable, one end of which is connectable to the socket of the main cable to bring the socket of the main cable up to the operating line.

12. A system as claimed in claim 10, wherein the support comprises a lock device for locking the support in one or more predetermined positions and preventing the support from moving.

13. A system as claimed in claim 10, wherein the support comprises a compass structure.

14. A system as claimed in claim 10, further comprising:

a number of work stations arranged along the unit and engaged by respective operating lines; and a cable transmission comprising guide members defining paths along which to run the main cable selectively to respective work stations.

15. A system as claimed in claim 10, wherein the work station is a mooring station engaged by a mooring line.

16. A floating production unit having at least one work station cooperating with an operating line; the unit comprising an operating line traction system as claimed in claim 10.

17. A method as claimed in claim 1, wherein the operating line comprises a mooring line.

18. A system as claimed in claim 10, wherein the operating line comprises a mooring line.

19. A floating production unit as claimed in claim 16, wherein the at least one work station comprises a mooring station; and wherein the operating line comprises a mooring line.

* * * * *